United States Patent [19]

Dziura

[11] 4,102,165

[45] Jul. 25, 1978

[54] KEY HOLDER

[75] Inventor: Walter Henry Dziura, Nautatuck, Conn.

[73] Assignee: Scovill Manufacturing Company, Waterbury, Conn.

[21] Appl. No.: 820,781

[22] Filed: Aug. 1, 1977

[51] Int. Cl.[2] ..... A47G 29/10

[52] U.S. Cl. ..... 70/456 B

[58] Field of Search ..... 70/456 R, 456 B, 457, 70/458, 459, DIG. 53, DIG. 54; 150/40; 24/3 K; 267/41, 89

[56] References Cited

U.S. PATENT DOCUMENTS

| | | | |
|---|---|---|---|
| 2,678,555 | 5/1954 | VanBuren | 70/456 B |
| 3,132,504 | 5/1964 | Beilis | 70/456 B |
| 3,309,905 | 3/1967 | Shepherd | 70/456 B |
| 3,700,392 | 10/1972 | Shears | 70/456 B |
| 3,732,713 | 5/1973 | Broughton | 70/456 B |

*Primary Examiner*—Robert L. Wolfe

*Attorney, Agent, or Firm*—Dallett Hoopes

[57] ABSTRACT

Key holder body is formed from a single blank and includes fingers formed from the back of the body and extending into the interior thereof. Some of the fingers, being shorter than others, are perforated at their line of flexure with the body to give them the same flexing characteristics as the longer ones.

1 Claim, 8 Drawing Figures

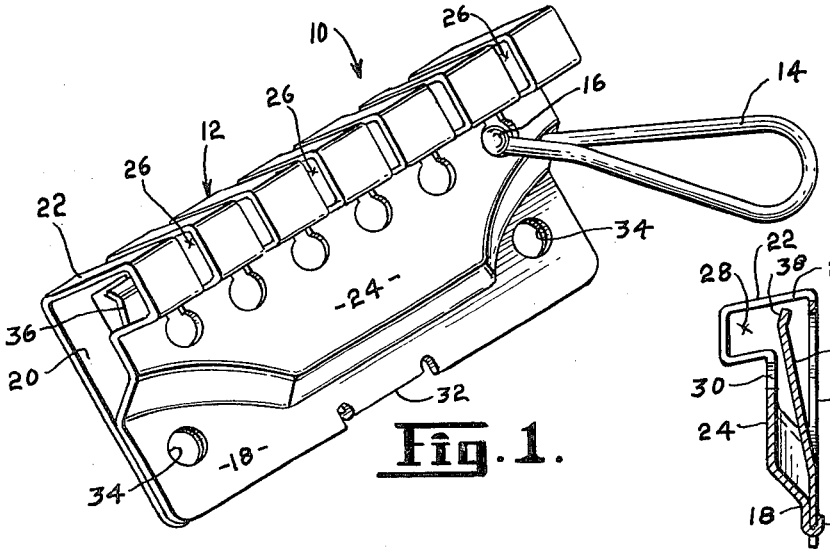
Fig. 1.
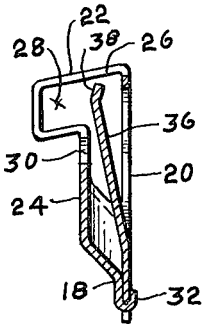
Fig. 2.
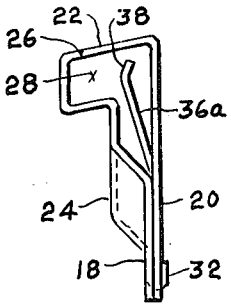
Fig. 3.
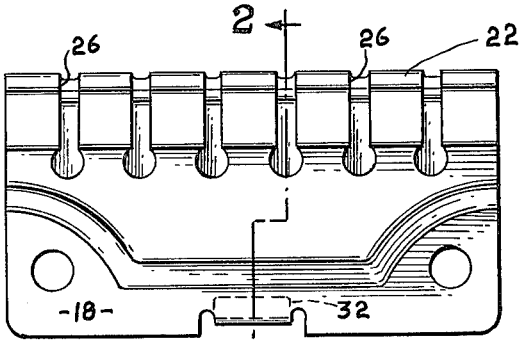
Fig. 4.
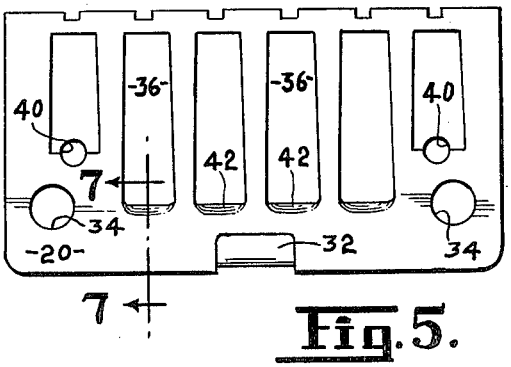
Fig. 5.
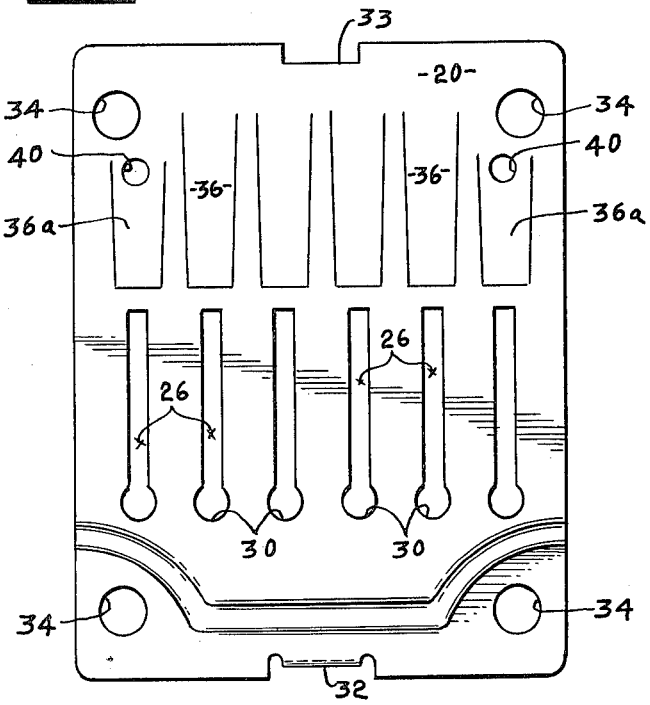
Fig. 6.
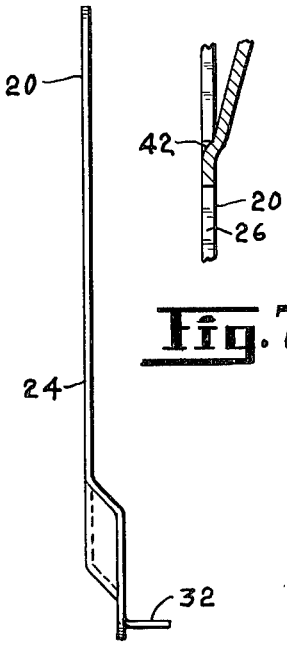
Fig. 7.
Fig. 8.

KEY HOLDER

BACKGROUND OF THE INVENTION

1. Field of the Invention

This invention relates to key holders of the type in which the cases are attached to individual hooks and the hooks are headed elements, the head portion being received into the slots respectively of a key holder body rivetted to a key case. More specifically, this invention relates to a key holder body formed from a single blank and being of a simple and rugged construction.

2. Description of the Prior Art

The prior art is replete with key holders of various descriptions. Examples are shown in the U.S. Pat. No. 3,006,182 to Hanna, issued Oct. 31, 1961, and the U.S. Pat. No. 3,309,905 to Shepherd, issued Mar. 21, 1967.

Prior art devices are characterized by having a special separate spring element inserted between the plate and base of the holder to assure that the heads of the hook members are held in their respective slots impeding their escape through the usual slot enlargements.

Other examples of prior art show attempts to eliminate the need for the aforesaid spring plate: U.S. Pat. No. 3,132,504 to Beilis, issued May 12, 1964, and U.S. Pat. No. 3,700,392 to Shears, issued Oct. 24, 1972. These prior patents, however, require an additional panel of metal extending from the holder to provide the spring runs, greatly enlarging the size of the blank. It has been assumed that such an arrangement was necessary in order to afford the spring run sufficient length to serve as sufficiently workable yet secure spring elements.

SUMMARY OF THE INVENTION

In the present invention, the usual front, top, and back portions of the body are formed with the usual slots with enlargements, and the back of the body is formed with a series of fingers extending toward the top and having their distal ends disposed in the interior of the holder body. In the preferred version, the holder is perforated adjacent the bottom thereof respectively at opposite corners and the fingers adjacent the openings, being shortened, are apertured to make them flex more readily so that the foreshortened fingers have a similar yield pressure as the longer fingers.

BRIEF DESCRIPTION OF THE DRAWING

Further objects of the invention will be apparent from a reading of the following specification and reference to the drawings, all of which embody a non-limiting form of the invention. In the drawings:

FIG. 1 is a perspective view of a holder embodying the invention;

FIG. 2 is a sectional view taken on the line 2—2 of FIG. 4;

FIG. 3 is an end view;

FIG. 4 is a front view;

FIG. 5 is a rear view;

FIG. 6 is a view of a blank from which a holder embodying the invention may be formed;

FIG. 7 is an enlarged fragmentary view taken on the line 7—7 of FIG. 5; and FIG. 8 is a side view of the blank shown in FIG. 6.

DESCRIPTION OF THE PREFERRED EMBODIMENT

Referring more specifically to the drawings, a holder embodying the invention is generally designated 10 in FIG. 1. It comprises a holder body 12 having a series of loops 14 headed as at 16.

The body 12 is formed from a blank (FIG. 6) and comprises a front 18, back 20, and top 22. As shown, the front 18 extends outward or upwardly from the base and merges into a second portion 24 which extends forwardly generally parallel to the plane of the base.

A plurality of generally keyhole-shaped slots 26 are formed in the loop-retaining section 28. As shown, the slots are formed with the circular enlargements 30 through which the heads 16 pass. As shown, the front and back of the holder are clamped together by a crimped-over tongue 32 adjacent the bottom of the holder which fits into the cut-out 33 on the back 20 (FIG. 6). Openings 34 are formed adjacent the bottom at opposite corners of the holder.

The back 20 (FIG. 5) is formed with a plurality of fingers 36 and **36*a* generally aligned with the slots 26 respectively, the distal ends of the fingers 36 and 36*a* extending into the interior of the key-retaining portion 28 (FIG. 2). The fingers 36 and 36*a* block the enlargements 30 respectively so that the heads 16 of the respective loops are precluded from working out through the enlargements 30. As shown, the very distal ends of the fingers 36 and 36*a* (FIG. 2) are deflected downwardly as at 38**.

In the preferred embodiment, the foreshortened fingers **36*a* are perforated as at 40 at the line of juncture between the fingers 36*a* and the back 20. The result is that the flexing of the fingers 36*a* adjacent the enlargements 30 requires approximately the same force as the flexure of the longer fingers 36 adjacent the enlargements 30**.

FIG. 7 is an enlargement showing a slight deflection as at 42, which deflection serves to slightly shorten the respective fingers so that they do not interfere with the margins of the back 20 about the openings formed when the fingers 36, **36*a*** are stamped. This assures a free movement of the fingers as desired.

While the present invention is described in connection with exemplary embodiments thereof, it is to be understood that modifications may be made in the construction and assembly thereof without departing from the broader spirit and scope of the invention, as defined in the following claim language:

I claim:

1. A key holder of the character described comprising a body of sheet material having front, top and back portions constructed with an internal region to contain heads of a plurality of key loops, said body having a plurality of parallel slots in the top portion along said region each narrower than the diameters of the heads of said key loops, said slots each extending to an enlarged opening in the front portion for passage of said heads therethrough, the enlarged openings being arranged in a linear path adjacent the juncture of said top and front portions, a series of fingers stamped from the back of the holder and extending toward the top and having their distal ends disposed in the internal region, the ends respectively overlaying said openings for holding inserted key loops in the holder and impeding their passage through said openings, the holder being formed with a pair of apertures therethrough adjacent the bottom thereof respectively at opposite corners thereof, the fingers adjacent the openings being foreshortened to allow space for the openings and the said adjacent fingers being perforated to make them flex more readily so that each finger flexes under approximately the same force as each other finger.

* * * * *